US007870704B2

(12) United States Patent
Riblier et al.

(10) Patent No.: US 7,870,704 B2
(45) Date of Patent: Jan. 18, 2011

(54) INSULATING GLAZING UNIT FOR AN OPENING LEAF OF A REFRIGERATED ENCLOSURE

(75) Inventors: Luc-Michel Riblier, Bussy Saint-Georges (FR); Helene Grussaute Ngheim, Arsy (FR); Marie Isabelle Watchi, Paris (FR)

(73) Assignee: Saint-Gobain Glass France, Coubevoie (FR)

( * ) Notice: Subject to any disclaimer, the term of this patent is extended or adjusted under 35 U.S.C. 154(b) by 499 days.

(21) Appl. No.: 11/914,980

(22) PCT Filed: Sep. 15, 2005

(86) PCT No.: PCT/FR2005/050744

§ 371 (c)(1),
(2), (4) Date: Nov. 20, 2007

(87) PCT Pub. No.: WO2006/125874

PCT Pub. Date: Nov. 30, 2006

(65) Prior Publication Data

US 2008/0164788 A1 Jul. 10, 2008

(51) Int. Cl.
*E04C 2/54* (2006.01)

(52) U.S. Cl. ..... 52/786.1; 52/786.11; 52/786.13

(58) Field of Classification Search ..... 52/786.1, 52/786.11, 786.13
See application file for complete search history.

(56) References Cited

U.S. PATENT DOCUMENTS 3,992,171 A 11/1976 Jenewein
4,024,494 A 5/1977 Quesnel
4,053,972 A 10/1977 Kordes
4,134,626 A 1/1979 Kordes
4,206,615 A 6/1980 Sobajima et al.
4,477,129 A 10/1984 Heaney
4,478,909 A 10/1984 Taniguchi
4,583,796 A 4/1986 Nakajima et al.

(Continued)

FOREIGN PATENT DOCUMENTS

EP 0 036 657 9/1981

(Continued)

OTHER PUBLICATIONS

Hussman, "Always Clear," Mar. 2004.
Mar. 21, 2005 letter to attorney prosecuting U.S. Appl. No. 10/341,525; Information material to the patentability of claims 90-124 of U.S. Appl. No. 10/341,525.

*Primary Examiner*—Richard E Chilcot, Jr.
*Assistant Examiner*—Branon C Painter
(74) *Attorney, Agent, or Firm*—Jeffrey S. Melcher; Manelli Denison & Selter PLLC

(57) ABSTRACT

The invention concerns an insulating glazing wherein the gap between the substrates is filled with at least one rare gas such as argon, krypton or xenon, the inter-layer sheet (50) has a thermal conductivity less than 1 W/m.K, preferably less than 0.3 W/m.K, a low-emissive coating being deposited on at least part of one of the substrates, an anti-frost coating being deposited on part of at least the outer surface of one substrate, the glazing being free of heating element, the glazing having a thermal conductivity coefficient U less than 1.2 W/m.K with a gas filling of at least 85%, and having a light transmission of at least 67% and a light reflection less than 18%.

61 Claims, 2 Drawing Sheets

U.S. PATENT DOCUMENTS

Figure 1:
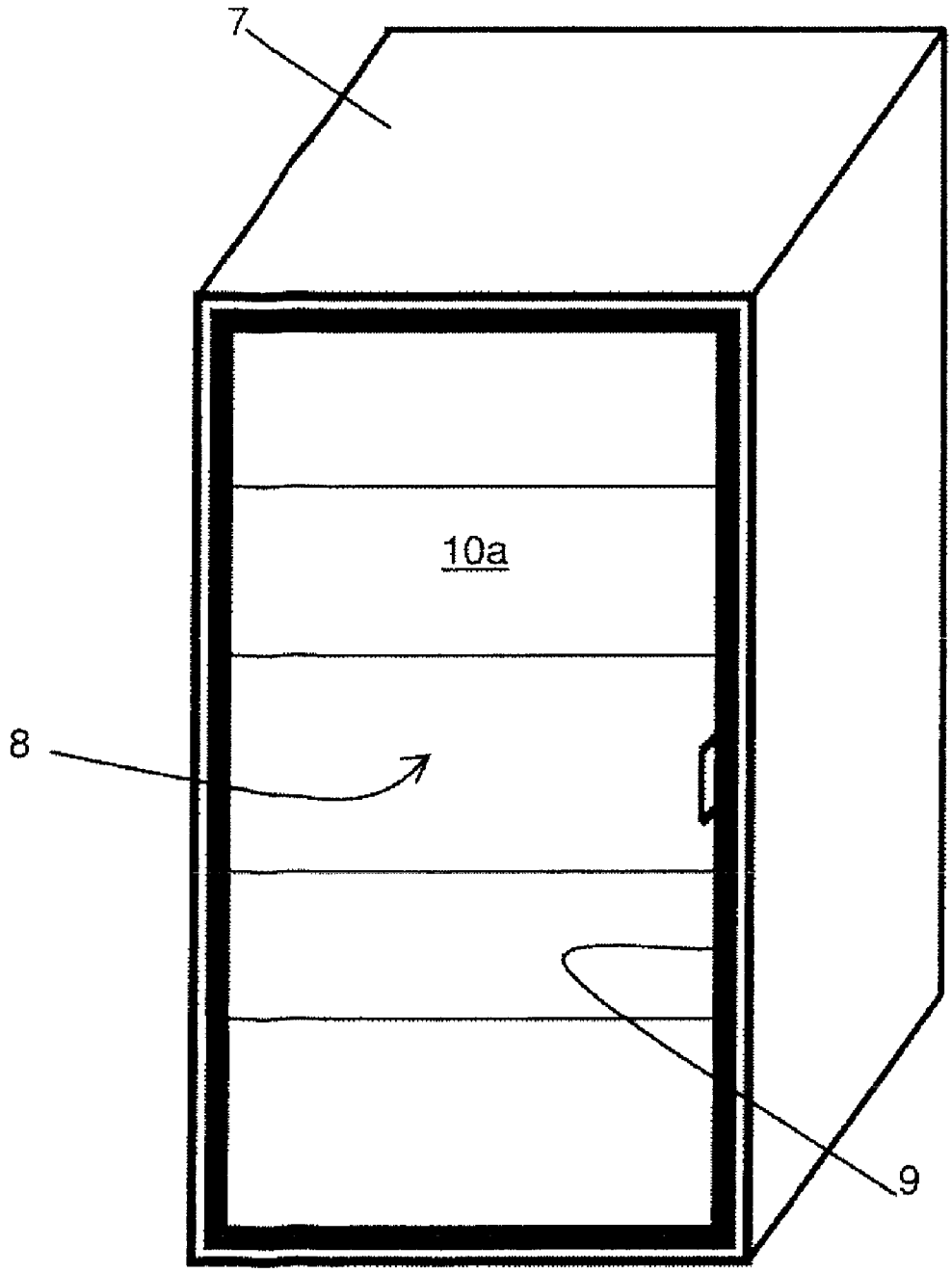

| | | | | |
|---|---|---|---|---|
| 4,656,781 | A | 4/1987 | Niekrasz et al. | |
| 4,691,486 | A | 9/1987 | Niekrasz | |
| 4,767,671 | A | 8/1988 | Parker | |
| 4,831,780 | A * | 5/1989 | Bockwinkel | 49/504 |
| 4,859,532 | A | 8/1989 | Oyama et al. | |
| 5,117,587 | A | 6/1992 | Doan | |
| 5,157,940 | A | 10/1992 | Bertu et al. | |
| 5,210,169 | A | 5/1993 | Muhlebach | |
| 5,262,475 | A | 11/1993 | Creasy | |
| 5,324,573 | A | 6/1994 | Evans | |
| 5,449,885 | A | 9/1995 | Vandecastele | |
| 5,476,682 | A | 12/1995 | Evans | |
| 5,584,143 | A | 12/1996 | Kennedy | |
| 5,753,373 | A | 5/1998 | Scholz | |
| 5,766,739 | A | 6/1998 | Funaki | |
| 5,778,689 | A | 7/1998 | Beatenbough | |
| 5,784,853 | A | 7/1998 | Hood | |
| 5,784,896 | A | 7/1998 | Tronnes et al. | |
| 5,852,284 | A | 12/1998 | Teder et al. | |
| 5,877,254 | A | 3/1999 | La Casse | |
| 5,962,090 | A | 10/1999 | Trautz | |
| 6,052,965 | A | 4/2000 | Florentin | |
| 6,094,306 | A | 7/2000 | Jain | |
| D430,174 | S | 8/2000 | Negrao et al. | |
| 6,144,017 | A | 11/2000 | Millett et al. | |
| 6,148,563 | A | 11/2000 | Roche et al. | |
| 6,164,739 | A | 12/2000 | Schulz et al. | |
| 6,185,948 | B1 | 2/2001 | Niki et al. | |
| 6,238,755 | B1 | 7/2001 | Harvey et al. | |
| 6,260,255 | B1 | 7/2001 | Richardson et al. | |
| 6,303,225 | B1 | 10/2001 | Veerasamy | |
| 6,362,414 | B1 | 3/2002 | Fujisawa et al. | |
| 6,367,223 | B1 | 4/2002 | Richardson et al. | |
| 6,394,613 | B1 | 5/2002 | Hatakeyama | |
| 6,401,399 | B1 | 6/2002 | Roche et al. | |
| 6,401,428 | B1 | 6/2002 | Glover et al. | |
| 6,540,884 | B1 | 4/2003 | Siddle | |
| 6,606,832 | B2 | 8/2003 | Richardson et al. | |
| 6,606,833 | B2 | 8/2003 | Richardson et al. | |
| 6,866,936 | B2 | 3/2005 | Opolski | |
| 2001/0002295 | A1 * | 5/2001 | Anderson et al. | 428/432 |
| 2002/0073645 | A1 | 6/2002 | Richardson et al. | |
| 2002/0078654 | A1 | 6/2002 | Richardson et al. | |
| 2003/0062813 | A1 | 4/2003 | Cording | |
| 2003/0197449 | A1 | 10/2003 | Cording | |
| 2003/0203991 | A1 | 10/2003 | Schottman et al. | |
| 2003/0205059 | A1 | 11/2003 | Roche et al. | |
| 2004/0222724 | A1 | 2/2004 | Cording | |
| 2004/0137155 | A1 | 7/2004 | Bernheim | |
| 2004/0194388 | A1 | 10/2004 | Roche | |
| 2004/0209019 | A1 | 10/2004 | Demars | |
| 2004/0022724 | A1 | 11/2004 | Cording | |
| 2005/0064101 | A1 | 3/2005 | Messere et al. | |

FOREIGN PATENT DOCUMENTS

| | | | |
|---|---|---|---|
| EP | 0 870 450 | A | 10/1998 |
| EP | 0 908 500 | A | 4/1999 |
| FR | 2 609 285 | | 7/1988 |
| GB | 2 199 360 | | 7/1988 |
| JP | 52 063186 | A | 5/1977 |
| JP | 57030823 | B4 | 7/1982 |
| JP | 59 021541 | A | 2/1984 |
| JP | 01 156390 | A | 6/1989 |
| JP | 02 110119 | A | 4/1990 |
| JP | 05222227 | A | 8/1993 |
| JP | 10 167764 | A | 6/1998 |
| JP | 11021511 | A2 | 1/1999 |
| JP | 11300269 | A2 | 11/1999 |
| JP | 2001294849 | A2 | 10/2001 |
| JP | 2002120818 | A2 | 4/2002 |
| JP | 2004143443 | A2 | 5/2004 |
| SU | 1 101 444 | A | 7/1984 |
| WO | WO 98/42163 | | 9/1998 |
| WO | WO 00/71481 | | 11/2000 |
| WO | 03/008877 | A2 | 1/2003 |
| WO | WO 03/008877 | A2 | 1/2003 |
| WO | WO 2006/034068 | A2 | 3/2006 |

* cited by examiner

INSULATING GLAZING UNIT FOR AN OPENING LEAF OF A REFRIGERATED ENCLOSURE

This application is a national stage entry filed under 35 U.S.C. 371 of PCT/FR2005/050744, filed 15 Sep. 2005. This application claims priority to U.S. patent application Ser. No. 11/137,373, filed 26 May 2005, the complete disclosure of which is incorporated herein by reference.

The invention relates to an insulating glazing unit intended for the opening leaf of a refrigerated enclosure in which cold or deep-frozen products are displayed, such as food or drinks, or any other product requiring to be kept cold, for example pharmaceutical products or even flowers. The insulating glazing unit consists of at least two glass substrates separated by a gas layer and provided on at least one of them with a low-E (low-emissivity) coating.

When products preserved in a refrigerated enclosure have to remain visible, as is the case in many current commercial premises, the refrigerated enclosure is equipped with glazed parts that convert it into a refrigerated "display case", the usual name for which is "refrigerated sales cabinet". There are several alternative forms of these "display cases". Some of them are in the form of a cabinet, and then it is the door itself that is transparent, while others are in the form of chests, and it is the horizontal lid that is glazed in order to allow the contents to be seen.

In these types of display cases, it is necessary for the merchandise to remain perfectly visible to customers so that they can preselect the merchandise without opening the "display case".

However, one of the main problems encountered in these display cases is the formation of fogging on the external face of the opening leaf, on the side facing the shop or store. This is because this external face is cooled by the refrigerated environment lying on the opposite side, the internal face side in contact with the internal environment of the enclosure, while being in contact with the surrounding atmosphere of the shop or store, which has a higher humidity and is at a much higher temperature: when the temperature of this external surface is at a temperature below the dew point, fogging occurs. This makes it difficult to see the merchandise.

Another major problem is also the formation of fogging, or even of frosting, on the internal face of the opening leaf when the display case is opened in order to take out the merchandise. This is because the surface of the inner glass substrate, which has to be at a very low temperature, indeed below 0° C., then comes into contact with the ambient atmosphere, which is of much higher humidity and at a much higher temperature. The temperature of the inner substrate is then below the temperature of the dew point, and this results in the phenomenon of condensation on the substrate, or even of frosting when the temperature of this substrate is negative. The presence of fogging or frosting makes it difficult to see the merchandise, and it is several minutes, or even tens of minutes, before the fogging or frosting completely disappears.

To alleviate these drawbacks, insulating glazing units in the prior art have been designed to have greater thermal insulation, namely double-glazing or triple-glazing units provided with one or more low-E coatings, and the substrate of which, in contact with the inside of the enclosure, is heated.

Also known, from patent application WO 03/008877, is a glazing unit of increased thermal insulation for a refrigerated enclosure which, according to said document, ensures that fogging disappears on the external face of the opening leaf, on the side facing the shop or store.

This type of insulating glazing unit consists of a triple glazing unit comprising three glass substrates 3 mm in thickness, spaced apart by gas layers of equal thickness, 8 or 13 mm, and consisting of air, argon or krypton, two low-E coatings being placed on faces 2 and 5 of the glazing unit (counting from the outermost face of the glazing in the closed position on the enclosure).

According to that document, the glazing unit has a heat transfer coefficient U not exceeding 0.2 BTU/hr.sq.ft.F or 1.11 $W/m^2.K$. It will be recalled that 1 $W/m^2.K$ corresponds to 0.18 BTU/hr.sq.ft.F.

The improvement in heat transfer coefficient U ensures, with the opening leaf in the closed position, that the outer surface is relatively warm compared with the temperature that it has because of the cold environment existing on its opposite side. This outer surface, on the shop or store side, is thus at a temperature above the dew point, preventing the formation of fogging on this outer surface when the display case is closed, but requiring no heating element on the outer substrate.

However, although the drawback of fogging on the shop or store side has been solved, the drawback of frosting, on the enclosure side, remains latent. This is because such a glazing unit requires a certain delay, even a few minutes, before the frosting on the inner surface of the glazing unit has disappeared. Furthermore, owing to the fact that the heat transfer coefficient U is higher, the outer surface of the internal substrate in contact with the refrigerated environment will be even colder, thereby encouraging even more frosting to form on the substrate when the display case is opened and requiring a longer time before it disappears.

To solve this second drawback—to prevent or to rapidly eliminate the fogging or frosting that has formed on the internal face of the glazing unit in contact with the inside of the enclosure—it is also known to provide, as already mentioned, heating elements placed on this internal face of the glazing unit.

However, the electricity consumed by such refrigerated display cases, especially owing to the heating elements deposited on the substrates, goes counter to energy saving—the very present preoccupation in durable development and environmental protection—and also represents higher costs for the stores.

Moreover, the various functional layers used, including the low-E coatings, are known to degrade the light transmission of the glazing units. To ensure that the merchandise is correctly visible from outside the enclosure, stores do not hesitate in fitting the inside of the enclosures with lighting which, apart from the additional energy expended, necessarily generates heat that may degrade the quality of the frozen products on display and the corresponding refrigerated unit will consume more energy.

The object of the invention is therefore to provide an optimum solution for an insulating glazing unit with an enhanced thermal property intended to be used for a refrigerated display case, which solution avoids the formation of fogging or frosting, even under difficult conditions as regards the external and internal environments of the display case, the frequency with which it is opened, for taking merchandise out of the display case or for restocking it, and which is efficient in terms of energy-saving and ensures that the products displayed in said display case are of high quality and can be easily seen.

In the rest of the description, it is to be understood that "inner" and "outer" are terms referring to elements that are turned toward the inside and the outside, respectively, of the refrigerated enclosure when the opening leaf is in the closed position.

"Internal" and "external" are understood to mean terms for elements that are turned toward the inside and the outside, respectively, of the insulating glazing unit.

According to the invention, the insulating glazing unit intended in particular for an opening leaf of a refrigerated enclosure comprises at least two glass substrates, at least one spacer of low thermal conductivity which keeps the two substrates spaced apart, and a low-E (low-emissivity) coating that is deposited at least partly on at least one of the substrates, characterized in that:

- the spacer has a thermal conductivity of less than 1 W/m.K, preferably less than 0.3 W/m.K;
- the airspace between at least two substrates is filled with at least one rare gas;
- the glazing unit contains no heating element;
- the glazing unit has a thermal conductivity coefficient U of less than 1.2 $W/m^2.K$, preferably less than 1.15 $W/m^2.K$ with a gas filling of at least 85%;
- the glazing unit has a light transmission of at least 67% and a light reflection of less than 18%; and
- the glazing unit further includes an anti-frost coating deposited on at least part of the external face of a substrate.

According to one feature, the gas is chosen from among argon, krypton and xenon.

According to another feature, a low-E coating is placed at least on face 2 and/or face 3 and/or face 4 of the glazing unit.

The faces of a glazing unit are numbered from 1 to 4 in the case of a double glazing unit or from 1 to 6 in the case of a tripe glazing unit, the faces of the glazing units, such as face 1, correspond to the outer surface of the glazing unit in contact with the ambient atmosphere, whereas face 4, or alternatively face 6, corresponds to that surface in contact with the refrigerated enclosure.

Preferably, an antireflection coating is deposited on at least one of the substrates, preferably on face 1 and/or on face 3 and/or on face 5 of the glazing unit.

According to a first embodiment of the invention, the insulating glazing unit is a triple glazing unit comprising three glass substrates, namely a first substrate, the external face of which is intended to be in contact with the inside of the enclosure with the opening leaf in its closed position, a second substrate or intermediate substrate, and a third substrate, the external face of which is intended to be in contact with the external environment of the enclosure, these substrates being separated from one another by the spacer of low thermal conductivity:

- the thickness of the substrates being between 2 and 5 mm, preferably being equal to 3 or 4 mm;
- at least one of the airspaces between the substrates being filled with at least one rare gas;
- the thickness of the gas layers being at least 4 mm;
- a low-E coating being deposited on face 2 and/or face 4 of the glazing unit;
- the anti-frost coating being deposited on at least part of the external face of the third substrate;
- the glazing unit having a thermal conductivity coefficient U of less than 1.1 $W/m^2.K$, or even less than 0.95 or 0.80 $W/m^2.K$, with a gas filling of at least 85%; and
- the glazing unit having a light transmission of at least 67% and an external light reflection of less than 18%.

According to one feature, the triple glazing unit includes a low-E coating on faces 2 and 4, and has a thermal transfer coefficient U of less than 1.0 $W/m^2.K$.

Advantageously, the low-E coating is deposited on that face of the glazing unit which is associated with the thicker gas layer.

Preferably, at least one antireflection coating is deposited on one of the faces of the glazing unit, preferably on at least one of faces 1, 3 and 5.

According to a variant of this embodiment, one of the gas layers has a thickness of 8 mm, whereas the other gas layer has a thickness of at least 10 mm, the gas layers being argon.

According to another variant of this embodiment, one of the gas layers is krypton and has a thickness of 8 mm, whereas the other gas layer is air and has a thickness of at least 10 mm.

According to a second embodiment of the invention, the insulating glazing unit is a double glazing unit comprising two glass substrates, namely a first substrate, the external face of which is intended to be in contact with the inside of the enclosure when the opening leaf is in its closed position, and a second substrate, the external face of which is intended to be in contact with the external environment of the enclosure, these being separated by the spacer of low thermal conductivity, the airspace between the substrates being filled with a rare gas:

- the thickness of the substrates being equal to 3 or 4 mm;
- the airspace between the substrates being filled with at least one rare gas;
- the thickness of the gas layer being at least 8 mm;
- a low-E coating being deposited at least on face 2 of the glazing unit;
- the anti-frost coating being deposited on at least part of the external face of the first substrate;
- the glazing unit having a thermal conductivity coefficient U of less than 1.15 $W/m^2.K$ with a gas filling of at least 85%; and
- the glazing unit having a light transmission of at least 75% and an external light reflection of less than 12%.

According to one feature, another low-E coating is deposited on face 3 of the glazing unit according to this second embodiment.

Preferably, it has a thermal conductivity coefficient U of less than 1.05 $W/m^2.K$ with a gas filling of at least 92%.

According to a variant of this embodiment, the gas layer is krypton.

According to another variant of this embodiment, the gas layer is xenon with a thickness of 8 mm.

Advantageously, the double glazing unit includes, on face 1 and/or face 3, an antireflection coating and has a light transmission of more than 80% and an external light reflection of less than 10%.

According to another feature of the insulating glazing unit of the invention, the anti-frost coating is such that, when the glazing unit provided with the anti-frost coating is brought into contact, on the side of the coating, with a temperature environment falling to at most −30° C., in particular −15° C., −18° C. or −24° C., and then brought into contact with an atmosphere at a temperature of at least 0°, preferably between 10° and 35°, especially between 15° and 30° and in particular between 23° and 27° C. and having a residual humidity of at least 25%, no frost formed for at least 12 s, preferably at least 1 minute, in particular at least 2 minutes, or even as long as at least 3 minutes.

This anti-frost coating includes an antifreeze compound that lowers the crystallization temperature, such as a salt, especially KCl, NaCl or equivalent in solution, and/or an alcohol, and/or a suitable hydrophilic polymer, copolymer, prepolymer or oligomer, optionally in water, and optionally one or more surfactants, this compound optionally having a hydrophobic character on part of its surface.

Advantageously, the antifreeze compound is combined with at least one other compound so as to obtain a physical or chemical interaction that mechanically reinforces the coating.

This antifreeze is, for example, polyvinylpyrrolidone, this being combined with a polyurethane so as to create a physical interaction, or it may be a polyol, this being combined with at least one isocyanate functional group so as to create a chemical interaction.

According to another feature of the insulating glazing unit, the spacer placed between the substrates comprises, in one embodiment, a first sealing barrier consisting of a body made of a thermoplastic, of the styrene acrylonitrile (SAN) or polypropylene type, said thermoplastic being blended with reinforcement fibers, of the glass type, and of a metal foil, of the aluminum or stainless steel type, which partly covers the thermoplastic, and also a second sealing barrier, which seals against liquids and vapor, of the polysulfide type.

According to another embodiment of the spacer, this consists, over at least part of the periphery of the glazing unit, of a substantially flat strip that is fastened to the edges of the substrates and is made of stainless steel, aluminum or plastic reinforced with reinforcement fibers, and comprising, on that face on the opposite side from the gas layer, a metal coating constituting a barrier that seals against vapor, gases and liquids. In addition, the spacer has a linear buckling strength of at least 400 N/m.

Preferably, at least the outer substrates of the insulating glazing unit of the invention are made of toughened glass.

Such an insulating glazing unit characterized above is advantageously used as an opening leaf, in particular for a refrigerated enclosure.

When the opening leaf includes, for supporting the glazing unit, a frame formed from aluminum and having a thermal bridge break, it advantageously has an overall heat transfer coefficient $U_W$ of less than 1.25 W/m$^2$.K for a gas filling of at least 92%.

When the opening leaf includes a frame formed from PVC, it has an overall heat transfer coefficient $U_W$ of less than 1.20 W/m$^2$.K for a gas filling of 92%.

The inventors have thus demonstrated the type of combinations of the various features of the glazing unit that have to be employed in order to provide the optimum solution as regards the thermal insulation and light transmission performance of the glazing unit, and to prevent the formation of fogging and frosting on the outer and inner faces of the glazing unit respectively, when it is used as an opening leaf in a refrigerated enclosure.

The invention thus relates to the combination of a set of features of the glazing unit, these being, in particular, the thickness of the gas layer, the type of gas, the type of spacer, the types of functional coating used and their position, the heat transfer coefficient of the glazing unit and the presence of an antifreeze layer.

Figure 2:
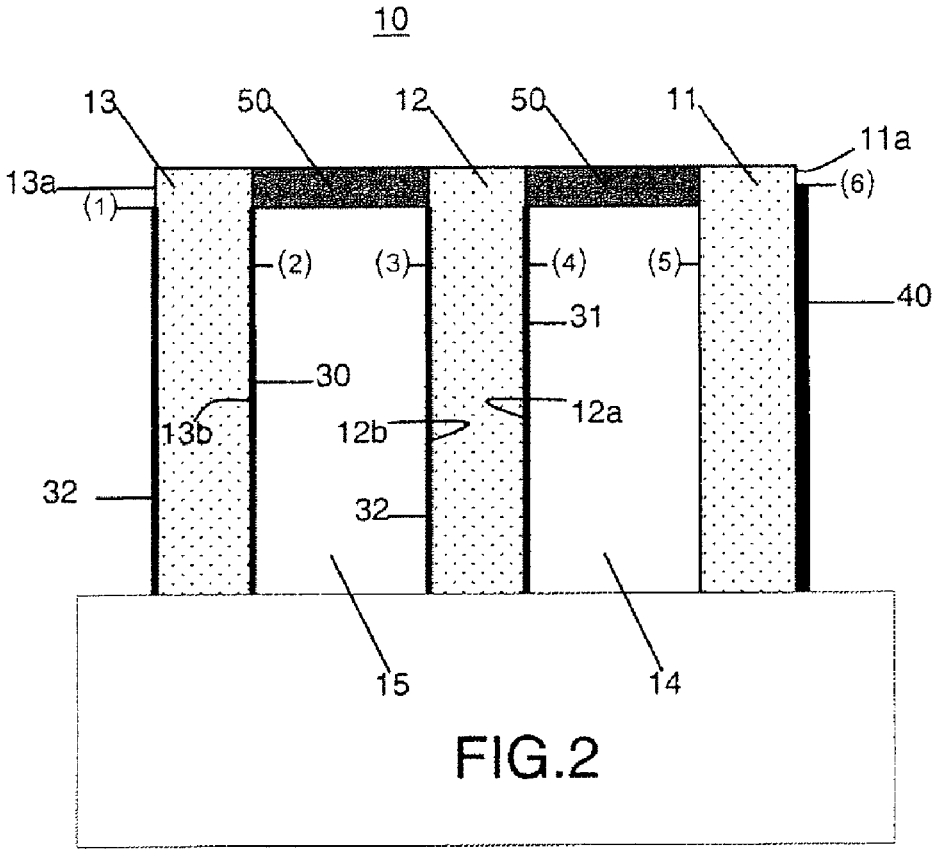
Figure 3:
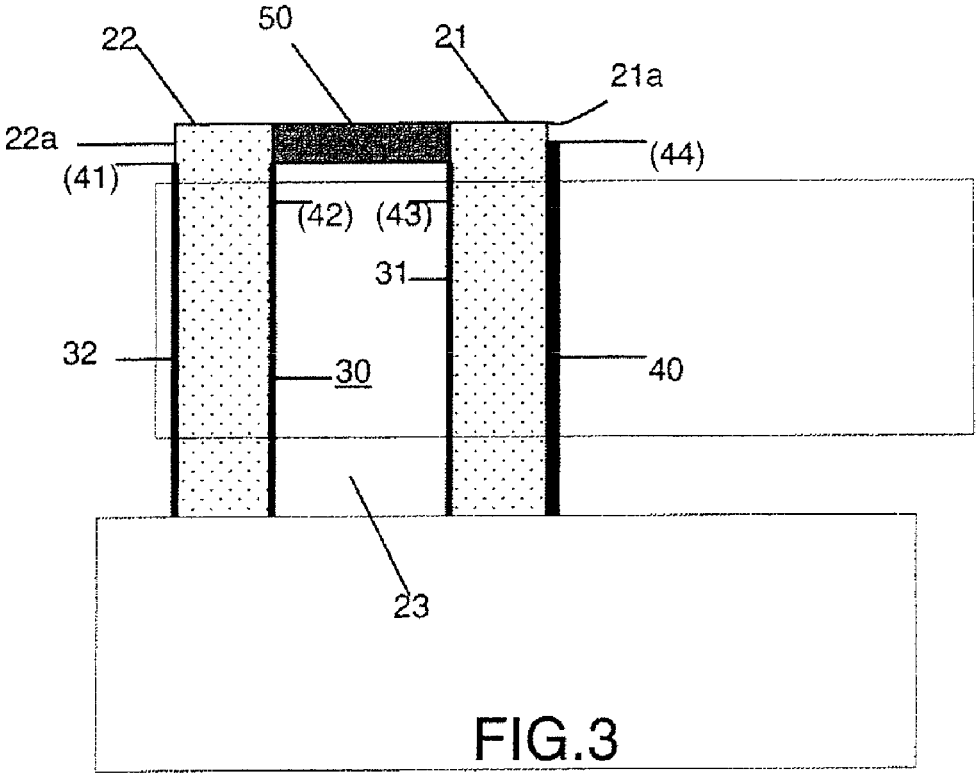

Other advantages and features of the invention will become apparent in the rest of the description with regard to the appended drawings, which are not drawn to scale, in which FIGS. 1 and 2 illustrate, respectively, two partial sectional views of two embodiments of a glazing unit according to the invention.

FIG. 1 illustrates, as a first embodiment of the invention, a gas-filled insulating triple glazing unit 10 containing no heating element and having at least one low-E coating 30 and an anti-frost coating 40, and exhibiting a heat transfer coefficient U of less than 1.2 W/m$^2$.K, preferably less than 1.15 W/m$^2$.K with a gas fill factor of at least 85%, and an external light transmission factor of at least 67% combined with a light reflection of less than 18%.

The triple glazing unit 10 comprises three glass substrates, namely a first substrate or inner substrate 11 the external face 11*a* of which is intended to be in contact with the inside of the enclosure when the opening leaf is in the closed position, a second substrate or intermediate substrate 12, and a third substrate or outer substrate 13, the external face 13*a* of which is intended to be in contact with the environment external to the enclosure. The first and third substrates 11 and 13 are preferably made of toughened glass.

The faces of the substrates are denoted by 1 to 6 and bear the references (1) to (6) in the figures—they correspond to the external face 13*a*, intended to be in contact with the environment external to the enclosure, as far as the face 11*a* intended to be in contact with the inside of the enclosure when the opening leaf is in the closed position, respectively.

The thickness of each of the substrates is between 2 and 5 mm, and it is preferably 3 or 4 mm so as to minimize the overall weight of the glazing unit and to optimize the light transmission.

The substrates are separated from one another by a spacer 50 of low thermal conductivity, which spacer may consist of two separate elements or a single element astride the intermediate substrate.

This spacer has a thermal conductivity coefficient of at most 1 W/m.K (or 1.88 BTU/hr.ft.F), preferably less than 0.7 W/m.K and better still less than 0.4 W/m.K. It will be recalled that 1 BTU/hr.ft.F corresponds to 0.534 W/m.K.

One example of a spacer has a base body made of a thermoplastic, of the styrene acrylonitrile (SAN) or polypropylene type, and reinforcement fibers, of the glass type, which are blended with the thermoplastic, and also a metal foil providing a gas and water vapor seal, which is adhesively bonded to one part of the base body, said part being intended to lie on the opposite side from the internal airspace of the glazing unit. The base body, which also includes a dehydrating agent, is deposited around the periphery and in the separating space between the substrates. An additional barrier, sealing the spacer with respect to liquids and vapor, which is made for example of polysulfide, polyurethane or silicone, is placed on the same side of the spacer as the metal foil.

Such a spacer, which is based on SAN and glass fibers, is known for example by the brand name SWISSPACER®, from Saint-Gobain Glass, when the metal foil of the base body is made of aluminum, and by the name SWISSPACER V® when the metal foil of the base body is made of stainless steel, and which, when combined with a double polysulfide barrier, has a thermal conductivity coefficient of 0.64 W/m.K (or 1.20 BTU/hr.ft.F) in the case of SWISSPACER® and 0.25 W/m.K (or 0.47 BTU/hr.ft.F) in the case of SWISSPACER V®.

Mention may also be made, as type of spacer, of the spacer disclosed in application WO 01/79644, which consists of a substantially flat profile placed, not on the inside of the glazing unit but on the outside, and fastened to the edges of the substrates. This strip may be based on stainless steel or aluminum or on a plastic reinforced with reinforcement fibers, its linear buckling strength being at least 400 N/m. This type of spacer includes, at least on one of its faces, a sealing barrier that seals against gases, dust and liquids, formed by a metal coating or a coating of any other suitable material.

The spacer is for example made entirely of aluminum, with a thickness of 0.5 mm, and has a thermal conductivity coefficient of 0.25 W/m.K (or 0.47 BTU/hr.ft.F).

The airspace between the inner substrate 11 and the intermediate substrate 12 is formed by an inner gas layer 14 and the airspace between the outer substrate 13 and the intermediate substrate 12 consists of an outer gas layer 15, the thickness of the gas layers being at least 4 mm and tailored according to the desired performance in terms of the heat transfer coefficient U, without however being greater than 16 mm.

At least one of the gas layers consists of a rare gas, which is chosen from argon, krypton and xenon, with a fill factor of at least 85%. For an even better coefficient U, filling to at least 92% with krypton or xenon will be preferred.

When the glazing unit has more than one gas layer, one of them may be air, and in this case the thickness of the air layer is at least 10 mm.

The glazing unit includes a low-E coating 30 placed on at least part of the face 13*b* of the outer substrate 13 facing the inside of the glazing unit (face 2) and/or another low-E coating 31 of the same type deposited on at least part of the face 12*a* of the intermediate substrate 12 facing the inner substrate 11 (face 4).

The low-E coatings could also be provided on faces 2 and 3. When the glazing unit is simply provided with a single coating it is preferably placed on that surface associated with the greatest gas layer thickness.

The low-E coatings are based on layers of metal and metal oxides that can be obtained by various processes, namely by vacuum processes (thermal evaporation, magnetron cathode sputtering) or by pyrolytic deposition of organometallic compounds, in liquid, solid or gaseous form, that are propelled by a carrier gas onto the surface of the heated substrate.

Preferably, the metal layers are based on silver and the metal oxide layers are based on zinc, tin, titanium, aluminum, nickel, chromium or antimony (Sb) compounds or nitride compounds or a mixture of at least two of these compounds, and optionally blocking layers, such as a blocker metal or a blocker metal alloy, of the Ti type, as upper layer of silver.

As examples, mention may be made of the following multilayer coatings, for which the notation ($TiO_2$) means that this is an optional element:

glass/$SnO_2$/($TiO_2$)/ZnO/Ag/Ti or NiCr or $NiCrO_x$/ZnO/$SnO_2$ or $Si_3N_4$/SnZnOx:Sb or $TiO_x$ glass/$SnO_2$/$TiO_2$/ZnO/Ag/$NiCrO_x$/($TiO_2$) /$SnO_2$/$SnZnO_x$:Sb.

For further details, in particular as regards the various embodiments of these multilayer coatings, thicknesses and amounts of compounds, the reader may refer to patent applications FR 2 783 918 or EP 1 042 247.

According to the invention, the type of coating allows a suitable compromise to be made between the optical quality of the substrate, in particular as regards its light transmission in the visible, and its reflection quality in the infrared.

The low-E coating used in the glazing unit of the invention has an emissivity not exceeding 0.3, preferably not exceeding 0.05, and a light transmission of greater than 75%, preferably greater than 85%.

Furthermore, the product PLANITHERM® FUTUR N from Saint-Gobain Glass, which has, as glass 4 mm in thickness, an emissivity of 0.04 and a light transmission of 88.4%, may be used as substrate provided with such a coating.

Another suitable product also according to the invention is PLANITHERM® ULTRA from Saint-Gobain Glass which has, as glass 4 mm in thickness, an emissivity of 0.02 and a light transmission of 86.7%. With such a product used for one or all of the substrates, the coefficient U may be even better in terms of insulation than with the product PLANITHERM® FUTUR N but the glazing unit will lose out slightly in terms of light transmission.

In addition, at least one antireflection coating 32 may be provided on one or more substrates, preferably on face 1 and/or face 3 and/or face 5. This has the advantage, apart from its antireflection function, of increasing the light transmission of the glazing unit and of further improving the visibility of the products in the display case.

Finally, the glazing unit includes an anti-frost coating 40 on the external face 11*a* of the inner substrate 11. This coating may be a layer deposited directly on the substrate or deposited on a plastic film fastened to the substrate.

In particular, this anti-frost coating prevents, when the glazing unit provided with the anti-frost coating is brought into contact, on that side of the coating, with a temperature environment falling to at most −30° C., in particular −15° C., −18° C. or −24° C., and then into contact with an atmosphere at a temperature of at least 0°, preferably between 10° and 35°, especially 15° and 30° and in particular 23° and 27° C. and with at least 25% residual humidity, any frosting forming for at least 12 s, preferably at least 1 minute, in particular at least 2 minutes or even as long as at least 3 minutes.

The value of 3 minutes, in accordance with the EN441 standard, is given for the usual conditions of use in a store. It goes without saying that the coating also fulfills its anti-frost function for any time that the opening leaf is open, and irrespective of the frequency with which it is opened, for any time of less than 3 minutes and as soon as the temperature on the coating side is at or below 0° C., whereas the temperature on the opposite side is above 0° C., and even accompanied by high humidity.

The anti-frost coating is adsorbent and absorbent.

It is adsorbent in the sense that the water molecules arriving on the surface of the substrate are attached to the surface and bond to the surface, allowing the coating to fully play its absorption function.

The coating is absorbent (hydrophilic) since the water molecules penetrate into it, and are thus absorbed.

The coating includes an antifreeze compound that lowers the crystallization temperature, such as a salt, especially KCl, NaCl or equivalent in solution and/or an alcohol and/or a suitable hydrophilic polymer, copolymer, prepolymer or oligomer, optionally in water, and optionally one or more surfactants, this compound optionally having a hydrophobic character on part of its surface.

Thus, the antifreeze compound makes it possible for bonds to be created between said compound and the water molecules, preventing the latter from linking together and forming water crystals constituting the frost.

As alcohols in the antifreeze compound, ethanol or isopropanol is especially employed.

The hydrophilic polymers, copolymers, prepolymers or oligomers as constituents of the solution are in particular based on polyvinylpyrrolidone of the poly(n-vinyl-2-pyrrolidone) or poly(1-vinylpyrrolidone) type, polyvinylpyrridine of the poly(n-vinyl-2-pyrridine) type, of the poly(n-vinyl-3-pyrridine) type or of the poly(n-vinyl-4-pyrridine) type, a polyacrylate of the poly(2-hydroxyethyl acrylate) type, a polyacrylamide of the poly(N',N-hydroxyacrylamide) type, polyvinyl acetate, polyacrylonitrile, or of the polyol type, such as polyvinyl alcohol, polyethylene glycol, polypropylene glycol, polyoxyethylene. In particular, the copolymers are based on at least one of the constituent monomers of these polymers.

The choice of hydrophilic polymer and of the porosity makes it possible in particular to regular the rate of water absorption and the water absorbtivity. The porosity of the layer is advantageously between 0.1 and 100 $cm^3/g$ and preferably less than 20 $cm^3/g$. The porosity defines the void volume of the pores per unit of weight of the layer.

As surfactants, mention may be made of compounds comprising a lipophilic part Y, which may be an unsaturated, linear or branched, aliphatic chain or an aromatic or alkylaromatic chain, and an ionic or nonionic hydrophilic head.

Examples of these are:

anionic surfactants: $Y—CO_2^-M^+$; $Y—OSO_3^-M^+$; $Y—SO_3^-M^+$; dodecylbenzene sulfonate; alkyl sulfonates; sulfonated fatty acids and fatty acid esters; alkylaryl sulfonates;

cationic surfactants: $Y—(R)_nNH^+_{(4-n)}$, $X^-$; $Y—R_4N^+$, $X^-$; alkyltrimethyl ammonium salts; alkylbenzyl-dimethyl ammonium salts; imidazolinium salts; amine salts;

zwitterionic surfactants: $Y—N^+ \ldots CO_2^-$; $Y—N^+ \ldots SO_3^-$; betaines; sulfobetaines; imidazolium salts; and nonionic surfactants: Y—OR; Y—OH; $Y—CO_2R$; Y—CONHR; $Y—(CH_2—CH_2—O)_n—$; polyols; alcohols; acids; esters; polyethoxylated fatty alcohols.

Furthermore, it is desirable for the antifreeze function of the coating to be lasting, which may require improving the mechanical strength of the layer incorporating the antifreeze compound, in particular when said layer is likely to suffer occasion mechanical contact, or has to be cleaned. For this purpose, the antifreeze compound may be crosslinked and/or combined with at least one other compound so as to establish a physical interaction or a chemical interaction with it, and/or it may be dispersed in a solid matrix, for example an organic or mineral matrix or a mixed matrix of the ORMOCER (organically modified ceramic) type, or a sol-gel compound.

The term "physical interaction" is understood here to mean a hydrogen bond, a polar interaction of the van der Waal's type or a hydrophobic interaction, these interactions being capable of providing mechanical reinforcement similar to crosslinking. Such physical interaction is for example achieved by mixing polyvinylpyrrolidone as antifreeze compound with polyurethane as matrix compound for said antifreeze compound.

Chemical interaction on the other hand results from blending the antifreeze compound with at least one other compound so as to create covalent bonds between them, the blend undergoing in a known manner a heat treatment for example, or a UV crosslinking step, a room-temperature crosslinking step, etc. It is thus possible to blend a polyol as antifreeze compound with another compound having isocyanate functional groups, and to heat this blend so as to obtain a polyurethane having the hydrophilicity functionality through the antifreeze compound and mechanical integrity through the chemical interaction between the hydroxyl functional groups of the polyol and the isocyanate functional groups.

For particular composition examples, the reader may refer to patent applications WO 00/71481 and FR 05/50271.

In this first embodiment of the invention, several alternative forms may be envisaged depending on the desired level of the heat transfer coefficient U, together with a compromise between size and weight of the glazing unit and its optical properties.

Table I below gives several embodiment examples A to E of triple glazing units that meet the desired performance requirements in terms of insulation and absence of fogging or frosting, without having to heat the glazing unit.

Indicated in this table are the overall thickness of the glazing unit, the thicknesses of the glass substrates, the face or faces of the glazing unit that include the low-E coating, the thicknesses of the gas layers, the type of gas, the light transmission and the outer light reflection provided by such glazing units, the heat transfer coefficient U of the glazing unit, for example obtained relative to the chosen gas and to the gas fill factor (85% or 92%), and the overall heat transfer coefficient $U_W$ of the opening leaf incorporating such a glazing unit.

For each of these examples:

the spacer 50 of low thermal conductivity consists of two separate elements for each of the two airspaces of the glazing unit, corresponding to the product SWISSPACER V® from Saint-Gobain Glass described above;

low-E coatings 30 and 31 are deposited on glass substrates corresponding to the products PLANITHERM® FUTUR N from Saint-Gobain Glass, with the exception of Example A1 which corresponds to Example A for which one of the substrates is replaced with PLANITHERM® ULTRA from Saint-Gobain Glass, the specific details of which were described above;

the anti-frost coating 40 is deposited directly on the glass substrate, this being an EVERCLEAR® coating sold by Saint-Gobain Glass; and the antireflection coatings 32 are deposited on glass substrates, these coatings corresponding to the VISIONLITE Plus® products from Saint-Gobain Glass.

The heat transfer coefficient U of the glazing unit was calculated at the center of the unit and according to the prEN 673 and prEN 410 standards. This calculation was also independent of the type of spacer.

The overall heat transfer coefficient $U_W$ of the opening leaf was calculated for the glazing units incorporated, respectively, in an aluminum frame with a thermal bridge break, a conventional frame for refrigerated enclosures and in a PVC frame. This calculation, according to the EN ISO 10077-2 standard, takes into account the dimensions of the opening leaf, of the glazing unit and of the frame, and also the type of spacer and the type of frame.

The opening leaf was of 1800 mm×800 mm format, the frame had a square section of 40 mm×40 mm with a heat transfer coefficient U of 2.6 $W/m^2.K$ in the case of aluminum and 1.8 $W/m^2.K$ in the case of PVC. The glazing unit was fitted into a rebate over a width of 25 mm.

TABLE I

| | Embodiment | | | | | | | |
|---|---|---|---|---|---|---|---|---|
| | A | A1 | B | B1 | B2 | C | D | E |
| Overall thickness (mm) | 29 | 29 | 29 | 29 | 29 | 29 | 35 | 35 |
| Outer substrate thickness (mm) | 4 | 4 | 4 | 4 | 4 | 4 | 4 | 4 |

TABLE I-continued

| | Embodiment | | | | | | | |
|---|---|---|---|---|---|---|---|---|
| | A | A1 | B | B1 | B2 | C | D | E |
| Central substrate thickness (mm) | 4 | 4 | 4 | 4 | 4 | 4 | 4 | 4 |
| Inner substrate thickness (mm) | 3 | 3 | 3 | 3 | 3 | 3 | 3 | 3 |
| Face 1 layer | — | — | — | — | — | — | — | anti-reflection |
| Face 2 layer | low-E | low-E | low-E | low-E | low-E | low-E | low-E | low-E |
| Face 3 layer | — | — | — | — | — | — | — | anti-reflection |
| Face 4 layer | low-E | low-E on PLANI-THERM ® ULTRA | low-E | — | low-E | low-E | low-E | low-E |
| Face 5 layer | — | — | — | — | — | — | — | anti-reflection |
| Face 6 layer | anti-frost | anti-frost | anti-frost | anti-frost | anti-frost | anti-frost | anti-frost | anti-frost |
| Outer gas layer thickness (mm) | 8 | 8 | 8 | 8 | 8 | 8 | 8 | 8 |
| Type of gas: outer layer | Argon | Argon | Kryp-ton | Kryp-ton | Kryp-ton | Kryp-ton | Argon | Argon |
| Inner gas layer thickness (mm) | 10 | 10 | 10 | 10 | 4 | 10 | 16 | 16 |
| Type of gas: inner layer | Argon | Argon | Kryp-ton | Kryp-ton | Kryp-ton | Air | Argon | Argon |
| Light transmission (%) | 71 | 69 | 71 | 72 | 71 | 71 | 71 | 79 |
| External reflection (%) | 15 | 16 | 15 | 17 | 15 | 15 | 15 | 7 |
| Coefficient U with 85% gas fill ($W/m^2 \cdot K$) | 0.96 | 0.93 | 0.69 | 1.04 | 0.93 | 0.90 | 0.79 | 0.79 |
| Coefficient U with 92% gas fill ($W/m^2 \cdot K$) | 0.93 | 0.91 | 0.64 | 0.98 | 0.86 | 0.86 | 0.77 | 0.77 |
| Coefficient $U_W$ with 92% gas fill and aluminum frame ($W/m^2 \cdot K$) | 1.16 | 1.14 | 0.89 | 1.21 | 1.09 | 1.09 | 1.01 | 1.01 |
| Coefficient $U_W$ with 92% gas fill and PVC frame ($W/m^2 \cdot K$) | 1.10 | 1.08 | 0.83 | 1.15 | 1.04 | 1.04 | 0.95 | 0.95 |

These glazing units thus have a heat transfer coefficient U of less than 1.1 $W/m^2.K$ with a gas fill factor of at least 85%, and even less than 0.80 $W/m^2.K$ when argon is used with a thickness of 16 mm for one of the gas layers (Examples D and E) and preferably less than 0.65 $W/m^2.K$ with krypton for both gas layers and with a fill factor of at least 92% (Example B).

The overall heat transfer coefficient $U_W$ of the opening leaf into which such glazing units is incorporated does not exceed 1.25 $W/m^2.K$ with a gas fill factor of at least 92%.

These glazing units thus make it possible to obtain a light transmission of at least 67% and an external light reflection of less than 18%. The figures given take account of the presence of the antifreeze layer, which lowers the light transmission factor by only about 0.5%.

In the case of Example A1, as already explained above, the use of the PLANITHERM® ULTRA low-E glass substrate makes it possible, compared with Example A, to further increase the thermal insulation performance, although the glazing unit does however lose out slightly in terms of optical quality, the latter nevertheless remaining very acceptable.

The use of an antireflection layer, for example, on faces 1, 3 and 5 (Example E) results in an overall transmission of 79.8% with reduced light reflection, namely 7.2%, giving the glazing unit very comfortable optical properties.

Example C, using only a single krypton layer, may be preferred to Example B when the cost of the glazing unit is of concern, since krypton is an expensive gas.

Moreover, this Example C also demonstrates the situation that would occur if the gas from one of the two gas layers of Example B were to leak out completely.

Finally, it is estimated that over the course of time the loss of gas in a glazing unit is 1% per year (prEN 1279-3) standard. Thus, after several years, a glazing unit would see its gas fill factor drop and consequently its thermal insulation performance would also drop. The row in the table indicating the coefficient U with a fill factor of 85% thus simulates the thermal performance of a glazing unit after 7 years when having been initially filled with 92% gas.

FIG. 2 illustrates a second embodiment of the invention for which the opening leaf 1 comprises an insulating double glazing unit 20 filled with xenon and/or with krypton and/or with argon, with no heating element, but including at least one low-E coating 30 and an anti-frost coating 40. This double glazing unit has a heat transfer coefficient U of less than 1.2 $W/m^2.K$, preferably less than 1.15 $W/m^2.K$, and a light transmission of at least 75%.

The double glazing unit 20 comprises two glass substrates 21 and 22 designed to be in contact with the environment of the refrigerated enclosure and with the external environment, respectively. They are spaced apart by a spacer 50 of low thermal conductivity, such as the one described in the first embodiment.

The gas layer 23 between the two substrates has a thickness of between 4 and 16 mm, preferably at least 8 mm.

A low-E coating 30 is placed on at least one inner face of the glazing unit, i.e. on face 2 and/or on face 3. The coating is of the type of those described in the first embodiment, being based on silver and on metal oxides.

The antifreeze coating 40 is deposited on the external face 21*a* of the inner substrate and corresponds to that described in the first embodiment.

An antireflection coating 32 may be provided on at least one of the substrates, preferably on face 1 and/or face 3 of the glazing unit.

Table II below illustrates three examples F, G and H of the double glazing unit according to the invention. The heat transfer coefficient U was calculated at the center of the glazing unit according to the prEN 673 and prEN 410 standards. This calculation was also independent of the spacer type.

The low-E coating corresponded to PLANITHERM® FUTUR N from Saint-Gobain Glass. The anti-frost coating corresponded to EVERCLEAR® from Saint-Gobain Glass and the antireflection coating corresponded to VISION-LITE Plus® from Saint-Gobain Glass.

Similarly to the first embodiment, the overall heat transfer coefficient $U_W$ of the opening leaf in which these types of double glazing unit are incorporated was calculated as explained above with the same dimensions, the same type of spacer and the same type of frame.

TABLE II

| | Embodiment | | |
|---|---|---|---|
| | F | G | H |
| Overall thickness (mm) | 16 | 16 | 18 |
| Outer substrate thickness (mm) | 4 | 4 | 4 |
| Inner substrate thickness (mm) | 4 | 4 | 4 |
| Gas layer thickness (mm) | 8 | 8 | 10 |
| Face 1 layer | — | antireflection | — |
| Face 2 layer | low-E | low-E | low-E |
| Face 3 layer | low-E | low-E | low-E |
| Face 4 layer | anti-frost | anti-frost | anti-frost |
| Gas layer thickness (mm) | 8 | 8 | 10 |
| Type of gas: outer layer | xenon | xenon | krypton |
| Light transmission (%) | 78 | 81 | 78 |
| External reflection (%) | 9.6 | 6.0 | 9.6 |
| Coefficient U with 85% gas fill ($W/m^2 \cdot K$) | 1.12 | 1.12 | 1.08 |
| Coefficient U with 92% gas fill ($W/m^2 \cdot K$) | 0.99 | 0.99 | 1.01 |
| Coefficient $U_W$ with 92% gas fill and an aluminum frame ($W/m^2 \cdot K$) | 1.22 | 1.22 | 1.23 |
| Coefficient $U_W$ with 92% gas fill and a PVC frame ($W/m^2 \cdot K$) | 1.16 | 1.16 | 1.18 |

These glazing units designed for opening leaves requiring smaller dimensions, having a smaller total thickness, thus have a heat transfer coefficient U of less than 1.15 $W/m^2.K$ for a gas fill factor of 85% and less than 1.05 $W/m^2.K$ for a gas fill factor of at least 92%. The opening leaves thus have an overall heat transfer coefficient $U_W$ of less than 1.25 $W/m^2.K$ for a gas fill factor of at least 92% with an aluminum frame, and even less than 1.20 $W/m^2.K$ for a gas fill factor of at least 92% with a PVC frame.

The light transmission for Examples F and G is at least 78% and very advantageously exceeds 81.5% when an antireflection coating is added, with a light reflection of 9.6% and 6.2% respectively.

The glazing units according to the first and second embodiments of the invention meet Environment Classes 2, 3, 4 and 5 given in the standard EN441 and repeated in Table III below, and in particular they meet Class 6 when the heat transfer coefficient U is below 0.8, such as in the case of Examples B, D and E.

TABLE III

| Environment Class According to the EN441 standard | Temperature (° C.) | Relative humidity (%) | Dew point (° C.) |
|---|---|---|---|
| 2 | 22 | 65 | 15.1 |
| 3 | 25 | 60 | 16.7 |
| 4 | 30 | 55 | 20.0 |

TABLE III-continued

| Environment Class According to the EN441 standard | Temperature (° C.) | Relative humidity (%) | Dew point (° C.) |
|---|---|---|---|
| 5 | 40 | 40 | 23.8 |
| 6 | 27 | 70 | 21.1 |

The invention claimed is:

1. An insulating glazing unit constructed and arranged for use in a leaf of a refrigerated enclosure, the glazing unit comprising:

at least first and second glass substrates, the first glass substrate having a first external face and a second face, the second glass substrate having a third face and fourth external face, the glazing unit is constructed such that when installed in a leaf and the leaf is in a closed position the first external face is exposed to an external environment and the fourth external face is in contact with an environment inside a refrigerated enclosure;

at least one spacer of low thermal conductivity retaining the first and second glass substrates spaced apart, the spacer having a thermal conductivity of less than 1 W/m.K;

a low-E (low-emissivity) coating at least partly on a face of at least one of the glass substrates having an emissivity not exceeding 0.3; and an anti-frost coating on at least part of the fourth external face, which avoids formation of fogging or frosting on the fourth external face when the glazing unit is used on a refrigerated enclosure and opened to take merchandise out of the enclosure or for restocking the enclosure so that the merchandise can be easily seen through the glazing unit, wherein, an airspace defined between the first and second substrates is filled with at least one rare gas;

the glazing unit contains no heating element;

the glazing unit has a thermal conductivity coefficient U of less than 1.2 W/m$^2$.K with a gas filling of at least 85%; and the glazing unit has a light transmission of at least 75% and a light reflection of less than 18%.

2. The glazing unit according to claim 1, wherein the spacer has a thermal conductivity of less than 0.3 W/m.K.

3. The glazing unit according to claim 1, wherein the glazing unit has a thermal conductivity coefficient U of less than 1.15 W/m$^2$.K.

4. The glazing unit according to claim 1, wherein the gas comprises at least one selected from the group consisting of argon, krypton and xenon.

5. The glazing unit according to claim 4, further comprising a low-E coating on at least one of the second face, the third face, or the fourth face.

6. The glazing unit according to claim 1, further comprising an antireflection coating on at least one face of the glass substrates.

7. The glazing unit according to claim 6, further comprising an antireflection coating on at least one of the first external face and the third face.

8. The glazing unit according to claim 1, wherein the thickness of the glass substrates is 3 or 4 mm, the thickness of the airspace is at least 8 mm, the low-E coating is present on at least the second face, the glazing unit having a thermal conductivity coefficient U of less than 1.15 W/m$^2$.K with a gas filling of at least 85%, and the glazing unit having a an external light reflection of less than 12%.

9. The glazing unit according to claim 8, wherein a second low-E coating is present on the third face.

10. The glazing unit according to claim 8, wherein the glazing unit has a thermal conductivity coefficient U of less than 1.05 W/m$^2$.K with a gas filling of at least 92%.

11. The glazing unit according to claim 8, wherein the airspace contains krypton gas.

12. The glazing unit according to claim 8, wherein the airspace contains xenon gas and has a thickness of 8 mm.

13. The glazing unit according to claim 8, further comprising an antireflection coating on at least one of the first external face and the third face, and the glazing unit has a light transmission of more than 80% and an external light reflection of less than 10%.

14. The glazing unit according to claim 1, wherein the glazing unit is constructed such that when the anti-frost coating is brought into contact with a temperature environment falling to at most −30° C. and then brought into contact with an atmosphere at a temperature of at least 0° and having a residual humidity of at least 25%, no frost is formed for at least 12 seconds on the anti-frost coating.

15. The glazing unit according to claim 1, wherein the glazing unit is constructed such that when the anti-frost coating is brought into contact with a temperature environment falling to at most −30° C. and then brought into contact with an atmosphere at a temperature of between 10° and 35° and having a residual humidity of at least 25%, no frost is formed for at least 12 seconds on the anti-frost coating.

16. The glazing unit according to claim 15, wherein no frost is formed for at least 1 minute.

17. The glazing unit according to claim 15, wherein no frost is formed for at least 2 minutes.

18. The glazing unit according to claim 15, wherein no frost is formed for at least 3 minutes.

19. The glazing unit according to claim 1, wherein the anti-frost coating comprises an antifreeze compound that lowers the crystallization temperature.

20. The glazing unit according to claim 19, wherein the antifreeze compound comprises at least one of a salt, an alcohol, or a hydrophilic polymer, copolymer, prepolymer or oligomer.

21. The glazing unit according to claim 20, wherein anti-frost coating contains one or more surfactants.

22. The glazing unit according to claim 19, wherein the antifreeze compound exhibits a hydrophobic character on at least part of its surface.

23. The glazing unit according to claim 19, wherein the antifreeze compound comprises at least one of KCl and NaCl.

24. The glazing unit according to claim 19, wherein the antifreeze compound is combined with at least one other compound so as to obtain a physical or chemical interaction that mechanically reinforces the anti-frost coating.

25. The glazing unit according to claim 24, wherein the antifreeze compound is polyvinylpyrrolidone which is combined with a polyurethane so as to create a physical interaction.

26. The glazing unit according to claim 24, wherein the antifreeze compound is a polyol which is combined with at least one isocyanate functional group so as to create a chemical interaction.

27. The glazing unit according to claim 1, wherein the spacer comprises a first sealing barrier having of a body comprising at least one styrene acrylonitrile (SAN) or polypropylene type thermoplastic, the thermoplastic being blended with reinforcement glass fibers, an aluminum or stainless steel metal foil which partly covers the body, and a second sealing barrier, which seals against liquids and vapors, and the second sealing barrier comprising a polysulfide.

28. The glazing unit according to claim 1, wherein the spacer comprises, over at least part of the periphery of the glazing unit, a substantially flat strip that is fastened to the edges of the glass substrates and comprises at least one of stainless steel, aluminum or plastic reinforced with reinforcement fibers, and comprising on a face on the opposite side from the airspace a metal coating providing a barrier that seals against vapor, gases and liquids.

29. The glazing unit according to claim 28, wherein the spacer has a linear buckling strength of at least 400 N/m.

30. The glazing unit according to claim 1, wherein at least one of the glass substrates is made of toughened glass.

31. An insulating triple glazing unit constructed and arranged to be used in a leaf of a refrigerated enclosure, the glazing unit comprising:

a first glass substrate having a first external face and a second face;

a second glass substrate having a third face and a fourth face;

a third glass substrate having a fifth face and a sixth external face, the glazing unit constructed such that when the glazing unit is mounted in a leaf and when the leaf is in a closed position the sixth external face is in contact with an inside of an insulated enclosure and the first external face is in contact with an external environment, the second glass substrate being disposed between the first and third glass substrates;

at least one spacer of low thermal conductivity retaining the substrates in separation from one another, a first airspace being defined between the first and second glass substrates and a second airspace being defined between the second the third glass substrates;

a low-E coating on at least one of the second face or fourth face of the glazing unit having an emissivity not exceeding 0.3;

at least one of the first and second airspaces being filled with at least one rare gas; and an anti-frost coating being deposited on at least part of the sixth external face, which avoids formation of fogging or frosting on the sixth external face when the glazing unit is used on a refrigerated enclosure and opened to take merchandise out of the enclosure or for restocking the enclosure so that the merchandise can be easily seen through the glazing unit, wherein, the thickness of the glass substrates being between 2 and 5 mm;

a thickness of each of the first and second air spaces being at least 4 mm;

the glazing unit having a thermal conductivity coefficient U of less than 1.1 $W/m^2.K$ with a gas filling of at least 85%; and the glazing unit having a light transmission of at least 75% and an external light reflection of less than 18%.

32. The triple glazing unit according to claim 31, wherein the glazing unit having a thermal conductivity coefficient U of less than 0.95 $W/m^2.K$.

33. The triple glazing unit according to claim 31, wherein the glazing unit having a thermal conductivity coefficient U of less than 0.80 $W/m^2.K$.

34. The triple glazing unit according to claim 31, further comprising a low-E coating on the second face and fourth face and the glazing unit has a thermal transfer coefficient U of less than 1.0 $W/m^2.K$.

35. The triple glazing unit according to claim 31, wherein the low-E coating is deposited on a face of the glazing unit which is associated with a thicker airspace.

36. The triple glazing unit according to claim 31, further comprising at least one antireflection coating on at least one of the faces of the glazing unit.

37. The triple glazing unit according to claim 36, wherein at least one antireflection coating is deposited on at least one of the first external face, the third face, or the fifth face.

38. The triple glazing unit according to claim 31, wherein at least one of the first and second airspaces has a thickness of 8 mm and the other airspace has a thickness of at least 10 mm, the gas in the first and second airspaces comprising argon.

39. The triple glazing unit according to claim 31, wherein at least one of the airspaces contains krypton and has a thickness of 8 mm and the other airspace contains air and has a thickness of at least 10 mm.

40. The glazing unit according to claim 31, wherein the glazing unit is constructed such that when the anti-frost coating is brought into contact with a temperature environment falling to at most −30° C. and then brought into contact with an atmosphere at a temperature of at least 0° and having a residual humidity of at least 25%, no frost is formed for at least 12 seconds on the anti-frost coating.

41. The glazing unit according to claim 31, wherein the glazing unit is constructed such that when the anti-frost coating is brought into contact with a temperature environment falling to at most −30° C. and then brought into contact with an atmosphere at a temperature of between 10° and 35° and having a residual humidity of at least 25%, no frost is formed for at least 12 seconds on the anti-frost coating.

42. The glazing unit according to claim 41, wherein no frost is formed for at least 1 minute.

43. The glazing unit according to claim 41, wherein no frost is formed for at least 2 minutes.

44. The glazing unit according to claim 41, wherein no frost is formed for at least 3 minutes.

45. The glazing unit according to claim 31, wherein the anti-frost coating comprises an antifreeze compound that lowers the crystallization temperature.

46. The glazing unit according to claim 45, wherein the antifreeze compound comprises at least one of a salt, an alcohol, or a hydrophilic polymer, copolymer, prepolymer or oligomer.

47. The glazing unit according to claim 46, wherein anti-frost coating contains one or more surfactants.

48. The glazing unit according to claim 45, wherein the antifreeze compound exhibits a hydrophobic character on at least part of its surface.

49. The glazing unit according to claim 45, wherein the antifreeze compound comprises at least one of KCl and NaCl.

50. The glazing unit according to claim 45, wherein the antifreeze compound is combined with at least one other compound so as to obtain a physical or chemical interaction that mechanically reinforces the anti-frost coating.

51. The glazing unit according to claim 50, wherein the antifreeze compound is polyvinylpyrrolidone which is combined with a polyurethane so as to create a physical interaction.

52. The glazing unit according to claim 50, wherein the antifreeze compound is a polyol which is combined with at least one isocyanate functional group so as to create a chemical interaction.

53. The glazing unit according to claim 31, wherein the spacer comprises a first sealing barrier having of a body comprising at least one styrene acrylonitrile (SAN) or polypropylene type thermoplastic, the thermoplastic being blended with reinforcement glass fibers, an aluminum or stainless steel metal foil which partly covers the body, and a second sealing barrier, which seals against liquids and vapors, and the second sealing barrier comprising a polysulfide.

54. The glazing unit according to claim 31, wherein the spacer comprises, over at least part of the periphery of the glazing unit, a substantially flat strip that is fastened to the edges of the glass substrates and comprises at least one of stainless steel, aluminum or plastic reinforced with reinforcement fibers, and comprising on a face on the opposite side from the airspace a metal coating providing a barrier that seals against vapor, gases and liquids.

55. The glazing unit according to claim 54, wherein the spacer has a linear buckling strength of at least 400 N/m.

56. The glazing unit according to claim 31, wherein at least one of the glass substrates is made of toughened glass.

57. A refrigerated enclosure having a leaf movably mounted to the enclosure, the leaf comprising an insulating glazing unit having:

at least first and second glass substrates, the first glass substrate having a first external face and a second face, the second glass substrate having a third face and fourth external face, the glazing unit is constructed such that when the leaf is in a closed position the first external face is exposed to an external environment and the fourth external face is in contact with an environment inside the refrigerated enclosure;

at least one spacer of low thermal conductivity retaining the first and second glass substrates spaced apart, the spacer having a thermal conductivity of less than 1 W/m.K;

a low-E (low-emissivity) coating at least partly on a face of at least one of the glass substrates having an emissivity not exceeding 0.3; and an anti-frost coating on at least part of the fourth external face, which avoids formation of fogging or frosting on the fourth external face when the refrigerated enclosure is opened to take merchandise out of the enclosure or for restocking the enclosure so that the merchandise can be easily seen through the glazing unit, wherein, an airspace defined between the first and second substrates is filled with at least one rare gas;

the glazing unit contains no heating element;

the glazing unit has a thermal conductivity coefficient U of less than 1.2 $W/m^2.K$ with a gas filling of at least 85%; and the glazing unit has a light transmission of at least 75% and a light reflection of less than 18%.

58. The refrigerated enclosure according to claim 57, wherein the leaf comprises a frame for supporting the glazing unit, said frame being formed from aluminum and having a thermal bridge break.

59. The refrigerated enclosure according to claim 58, wherein the leaf has an overall heat transfer coefficient $U_W$ of less than 1.25 $W/m^2.K$ for a gas filling of at least 92%.

60. The refrigerated enclosure according to claim 57, wherein the leaf comprises a frame for supporting the glazing unit, said frame being formed from polyvinyl chloride.

61. The refrigerated enclosure according to claim 60, wherein the leaf has an overall heat transfer coefficient $U_W$ of less than 1.20 $W/m^2.K$ for a gas filling of 92%.

* * * * *